US005116102A

United States Patent [19]

Chaundy

[11] Patent Number: 5,116,102

[45] Date of Patent: May 26, 1992

[54] FISHING BOAT CHAIR AND BRACKET THEREIN

[76] Inventor: Robert L. Chaundy, P.O. Box 1075, Solomons, Md. 20688

[21] Appl. No.: 553,571

[22] Filed: Jul. 17, 1990

[51] Int. Cl.[5] ..... B60N 1/02

[52] U.S. Cl. ..... 297/357; 297/355; 297/376

[58] Field of Search ..... 297/357, 354, 378, 417, 297/355, 376

[56] References Cited

U.S. PATENT DOCUMENTS

| | | | |
|---|---|---|---|
| 1,596,316 | 8/1926 | Singleton | 297/357 |
| 1,952,376 | 3/1934 | Knabusch et al. | 297/357 X |

FOREIGN PATENT DOCUMENTS

| | | | |
|---|---|---|---|
| 724310 | 4/1932 | France | 297/357 |
| 1146368 | 11/1957 | France | 297/357 |
| 75744 | 6/1961 | France | 297/357 |
| 487287 | 11/1953 | Italy | 297/357 |

*Primary Examiner*—Laurie K. Cranmer
*Attorney, Agent, or Firm*—Wm. D. Johnston, III

[57] ABSTRACT

A bracket and a fighting chair for a fishing boat incorporating the bracket. The bracket includes a first part which can be attached to the seat of a fishing chair, and which has two removable pins and a fixed pin extending between two walls, and a rotating part which has a near end with a slot which is inserted between the two walls of the fixed part to engage the pins. The rotating part has a far end which can be attached to the back of the chair. With the bracket incorporated in the chair, the seatback has an upright position, an intermediate reclining position, a down position underneath the seat of the chair where the seatback is entirely out of the way, and a locked position just beyond the down position. The seatback is moved by one member of the crew from the upright position to the intermediate reclining position by first lifting the seatback upwards, or by use of less force by lifting the seatback up while at the same time rotating it slightly forward, after which the seatback can be rotated backwards to the intermediate reclining position. The seatback can be rotated further backwards to the down or locking positions, where it is out of the way under the seatbottom. The bracket or a simplified version of it has several other uses in the fishing boat.

25 Claims, 6 Drawing Sheets

FISHING BOAT CHAIR AND BRACKET THEREIN

BACKGROUND OF THE INVENTION

The invention relates to chairs for boats for fishing for big game fish by rod and reel, and to a bracket used in the chair.

Boats for sportfishing for large game fish by rod and reel typically are furbished with special chairs called fighting chairs. These chairs are made to provide various features of use and convenience for the person doing the fishing (hereafter referred to as the fisherman), who typically hires the boat for the excursion. Generally there will be one or more members of the crew tending to the fisherman, particularly when a fish has been hooked and the battle to bring it in is underway. During this struggle the crew must provide in a variety of ways for the aid and comfort of the fisherman. Likewise, the captain of the boat, at the helm on the fly-bridge above and forward of the fighting chairs, must closely observe the fisherman, the fish and the line leading to the fish, to decide how to best maneuver the boat during this period.

Such fighting chairs typically involve a seatback or backrest that can be tilted from a normal upright position to an intermediate tilted-back position or removed entirely off the chair and stowed, by one or more members of the boat's crew. This generally is done after a strike is made and the battle to land the fish has begun.

This backward-inclining or removal of the seatback during the struggle to land the fish serves two purposes. It allows full freedom of forward and backward motion for the fisherman fighting to land the fish, who typically rocks his or her upper body forward and back through a large angular range, while holding the fishing rod more or less integrally with the upper body. The rocking backwards motion hauls the fish closer to the boat, while the rocking forward allows the line to be reeled in with less tension on the line and less force by the operator on the rod and reel than without the rocking motion.

The second purpose served by removing the seatback is due to the typically cramped quarters on the boat and the level of activity demanded of the one or more members of the crew while the fish is being landed. Again, this aid requires some intense activity by the crew, and a close watch by the captain on the fly-bridge who must keep a close eye in several directions. By removal of the seat, the crew are aided in these efforts, and better service generally is provided to the fisherman, but a problem arises with where to temporarily store the seatback, where it will be out of the way and not damaged. Also, usually at least one crew member is needed to remove the seatback, which causes a distraction from the attention being paid to the fisherman at a critical time.

After a strike is made and the battle is on, the captain generally stands facing forward, in able to watch the fisherman and the line over his shoulder, or the captain stands at an angle from the forward direction, to keep the fisherman more squarely in view while also keeping an eye ahead. However, in either case, the back of the captain's own chair typically is in the captain's line of sight to the fisherman below and to one side of the captain, thus interfering with the captain's view of the fisherman.

In the above scenario the fisherman was considered to be sitting or reclining in the fishing chair with the seatback in the upright or possibly in the intermediate position, holding the rod in expectation of a strike. An alternative but also typical scenario is different in that what is referred to in the trade as a rocket launcher is also attached to the chair, in which case the fisherman does not take his or her place in the chair until a strike occurs and the rocket launcher is removed out of the fisherman's way. The rocket launcher is a support for holding a plurality of fishing rods, which have been baited and the lines of which have been paid-out to simultaneously trail behind the boat as it trolls in search of fish, in hopes of a strike. After a strike is made on the line of one of the rods, the other rods are stowed and the rocket launcher is removed and stowed.

Thus, in the prior art, either the seatback or the rocket launcher must be removed and stowed after a strike occurs. Also, in the prior art arrangements, the rocket launcher cannot simply be rotated backward and down, while remaining connected to the chair, since the leg support extending diagonally down and forward from below the back of the chair is in the way in the usual configuration.

SUMMARY OF THE INVENTION

It is an object of the invention to provide a bracket comprising a rotating part which may for instance be fastened to the back of a fishing boat chair and a stationary part which may be fastened to the seat of the chair, the reference to the chair in describing the bracket being only for convenience.

It is a further object of the invention to provide the rotating part of the bracket with an upright position, optionally an intermediate inclined position, a fully down position and optionally a locking position, relative to the stationary part of the bracket, which are reached in that order by rotation of the rotating part in the backward or reclining direction of the seatback with respect to the chair.

It is a further object of the invention to provide the bracket so that the movement of the rotating part from the upright position to the intermediate or fully down position cannot occur until the rotating part of the bracket is first lifted, and preferably also moved forward to reduce the amount of lift required, i.e., preferably the rotating part, in concert with the lifting, is also rotated in the forward direction which is opposite to the reclining direction, before the rotation in the reclining or backward direction can occur.

It is a further object of the invention to provide the bracket so that the rotating part must be rotated a small amount in the direction away from the intermediate position, before it can be lifted vertically for the rotation in the opposite direction to the Intermediate position.

It is a further object of the invention to provide a bracket with a first removable pin which, if used in the fishing chair, allows easy removal of the seatback from the chair by removal of the first removable pin of each bracket in the chair.

It is a further object of the invention to provide the bracket with a second removable pin to define, when the second removable pin is in place, said upright position, which second removable pin does not have to be removed to allow the rotating part to rotate from the upright position to the fully down position.

It is a further object to provide holes in the rotating and fixed parts of the bracket so that the second removable pin can be removed, the seatback swiveled a bit further beyond the fully down position to a locking position, and the second removable pin reinserted to lock the two parts in this locking position, or to lock the seatback in a locking position under the fishing chair when incorporating the bracket in the chair.

It is a further object to provide a fighting chair for a fishing boat incorporating the bracket, wherein the seatback can be stably retained in the upright position, or rotated backwards to an intermediate reclining position, or to a fully down position under the fighting chair where it is held securely out of the way, by first raising the seatback vertically or rotating it slightly in the forward direction, or a combination of the two, without removal of any pins.

It is a further object of the invention to provide a fighting chair wherein the seatback can be easily moved by one crew member, while the fisherman in the chair is responding to a strike by a fish, from the upright position to either an intermediate reclining position or past the intermediate reclining position to the fully down position, at which the seatback is secure and effectively stowed out of harm's way.

It is a further object of the invention to provide a fighting chair wherein the seatback, if desired, can be easily moved and locked in place in the locking position beyond the fully down position, by inserting the first removable pin defining the upright position, once the seatback is in the locking position.

It is a further object of the invention to use the bracket to support a rocket launcher at the back of the chair, so that the rocket launcher can be folded from an upright position backward and down to a retracted position underneath the fighting chair, when a fish strikes or is seen to be close to striking and the fisherman wishes to occupy the chair and take the respective rod in hand.

It is a further object of the invention to use the bracket in the captain's chair on the bridge, so that the seatback of the captain's chair can be folded down after a strike to help the captain keep an eye on the client and the line with the fish on the end while controlling the boat's maneuvers.

It is a further object of the invention to provide stability of the seatback in each of the positions, and a compact yet sturdy and efficient fighting chair, as befits a properly equipped boat.

DETAILED DESCRIPTION OF PREFERRED EMBODIMENTS

The following references to the drawings are for the purposes of describing various preferred embodiments of the invention only. Various modifications and extensions of the present invention would be apparent to a person versed in this art in possession of the present disclosure.

Figure 1A:
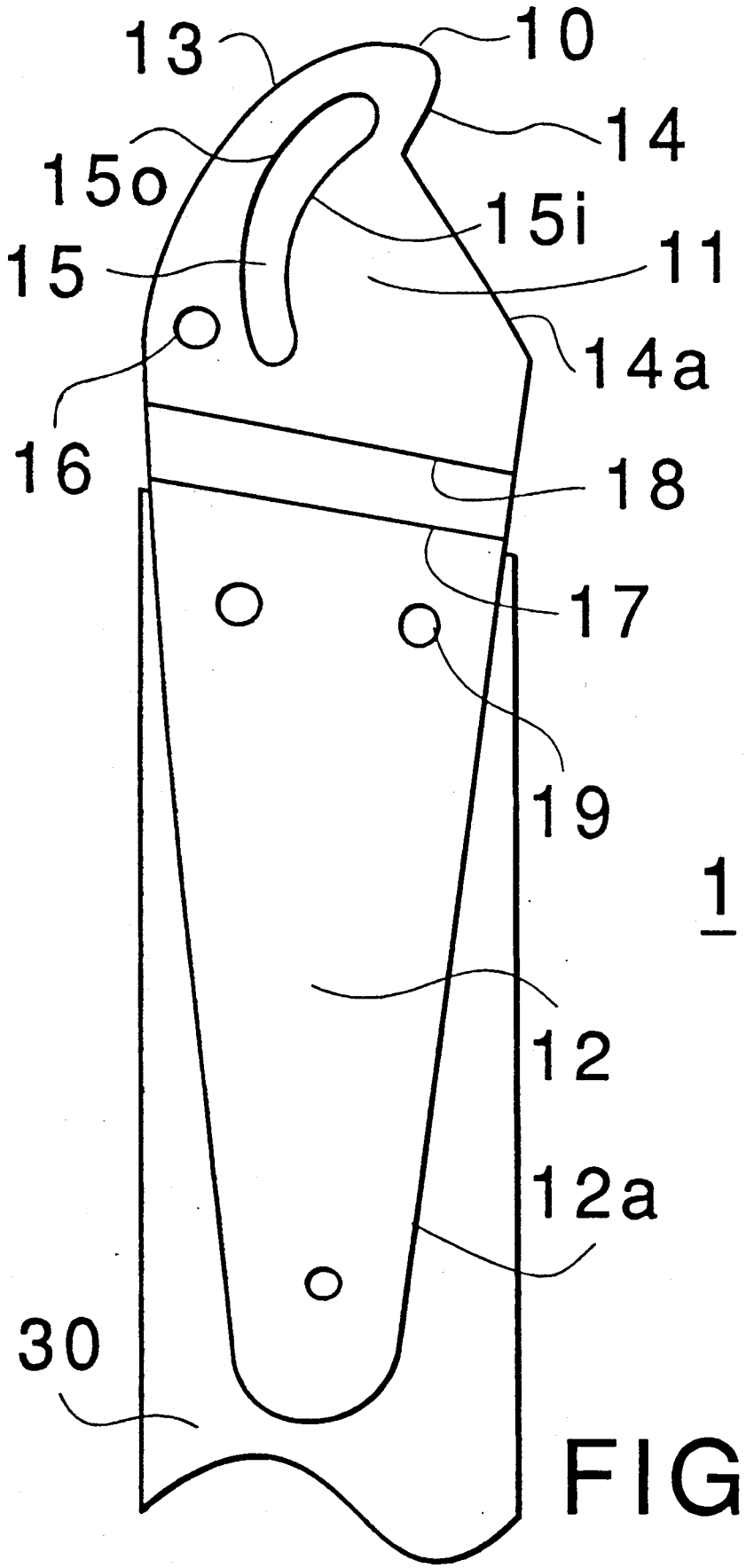
FIGS. 1A and 1B respectively show side and front views of the rotating part of the bracket of the present invention, oriented in the down position.
Figure 1B:
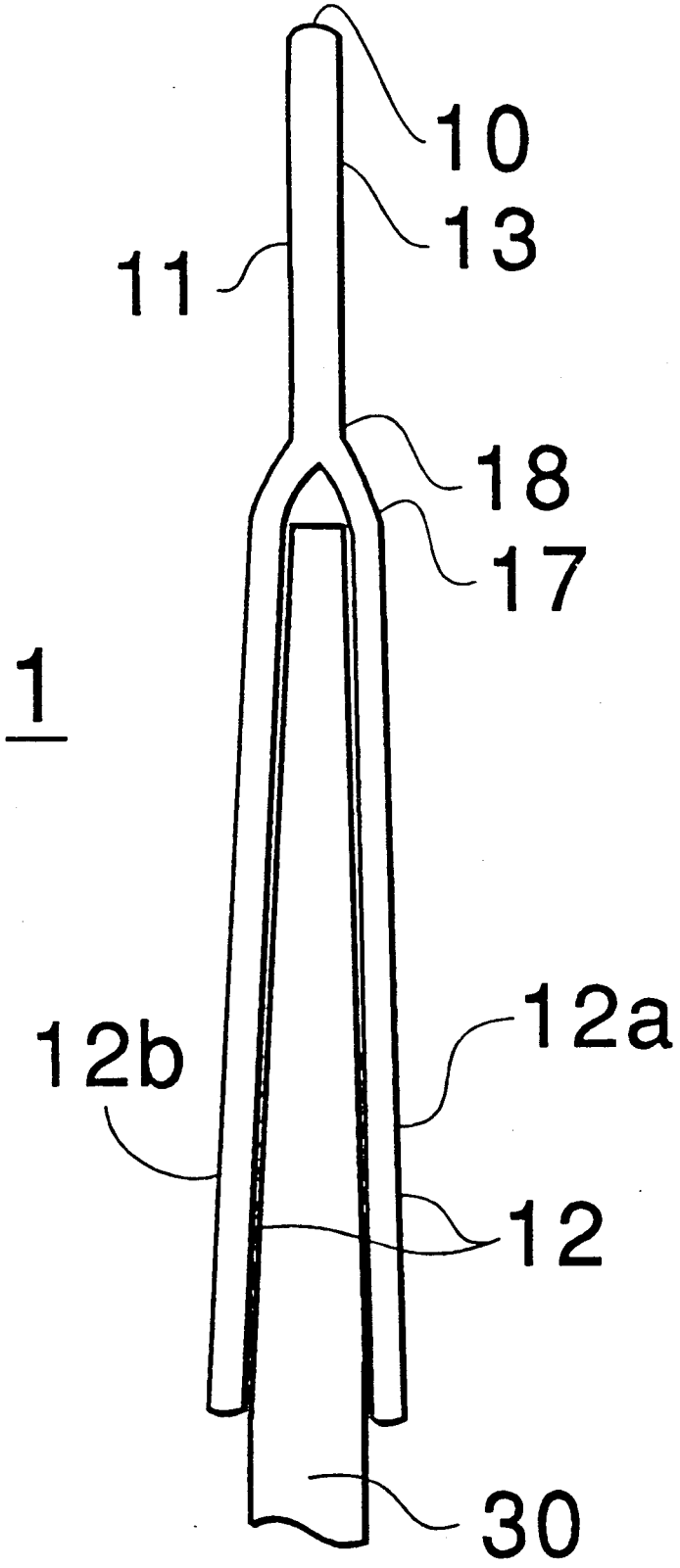

FIGS. 1A and 1B respectively show side and front views of the rotating part 1 of the bracket of the present invention. The part 1 includes a near portion 11 and a far portion 12, the near portion 11 having an extreme tip 10, surfaces 13, 14 and 14*a* on either side of the near portion 11, the curved slot 15 with inner surface 15*i* and outer surface 15*o*, the locking hole 16 and the first seam 18 where the two legs 12*a*, 12*b* of the far portion 12 of the part 1 first diverge from the body of part 1, each of the two legs 12*a*, 12*b* having a bend 17. The view of FIG. 1B is from the left side of FIG. 1A. Both views show the part 1 oriented in the down position, that is, as it would be hanging down if incorporated in a fishing chair according to further aspects of the present invention. The width of the rotating part 1 as shown in FIG. 1A may be 2 and $\frac{7}{8}$ inches at its widest point, and the length 10 and $\frac{3}{8}$ inches. FIG. 1B indicates a seatback support 30 extending from the rotating part 1, where it is bolted between the two legs 12*a*, 12*b* via holes 19.

Figure 2A:
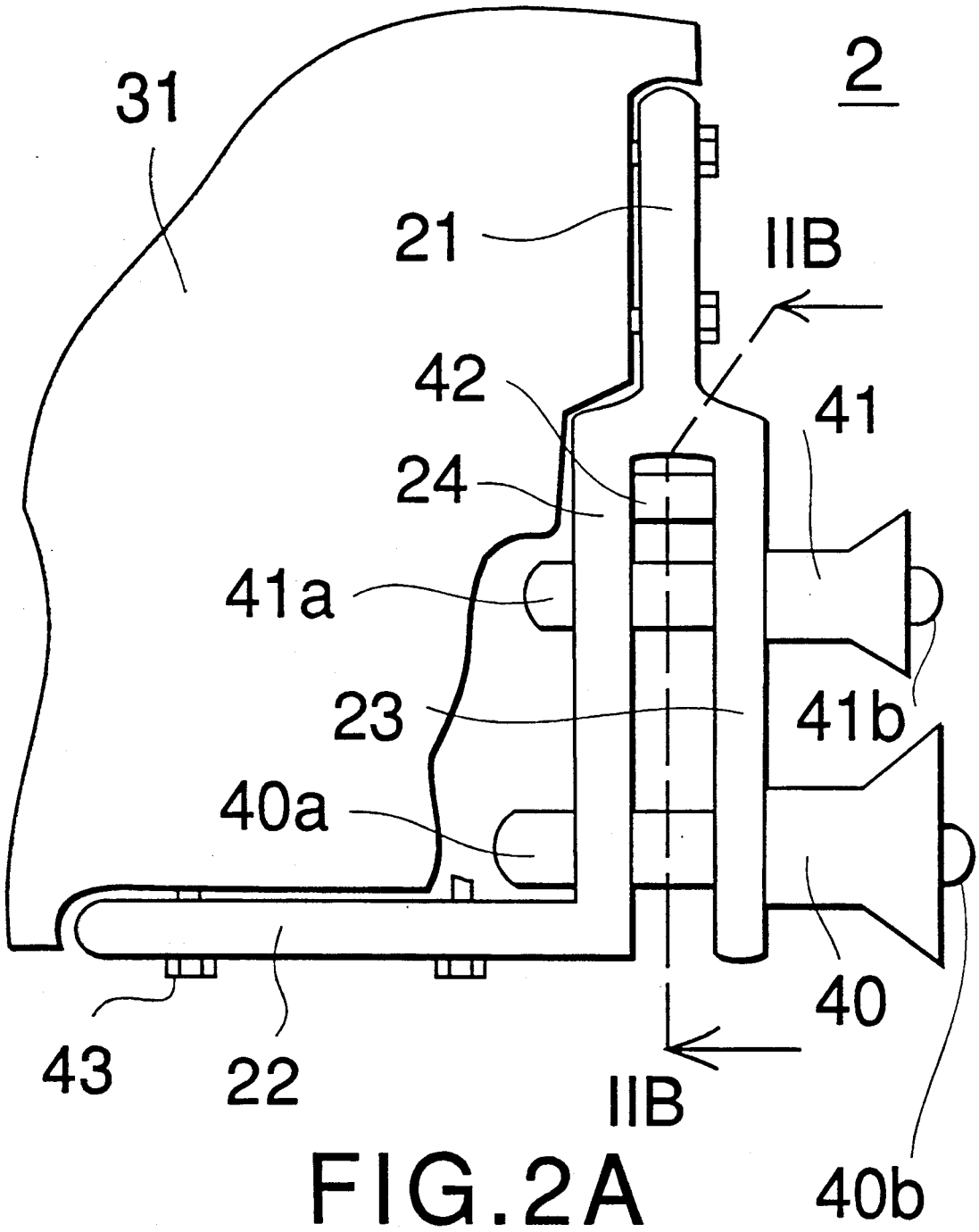
FIGS. 2A and 2B respectively show plan and cutaway side views of the fixed part of the bracket of the present invention attached to the seat, with the three pins for engaging the rotating part, with FIG. 2B indicating with dotted lines different positions of the rotating part of the bracket.

FIG. 2A shows the downward looking plan view of the seat of the fishing chair, with the part 2 attached to the back right corner of the seat 31 of the chair by the bolts 43 passing through holes in the two sections 21, 22 of the part 2, the forward part of the seat being in the upward direction. Thus it is clear that the illustrated parts 1 and 2 form, together with the other illustrated parts, what would be termed a right-side bracket, and that a fishing chair according to the present invention would involve both a right- and a left-side bracket, each one on the respective back corner of the chair.

FIG. 2A shows also the first removable pin 40 and the second removable pin 41 passing through respective holes in the outer and inner walls 23, 24 of the part 2, and the fixed pin 42 fixed permanently between the inner and outer walls 23, 24. The first and second removable pins 40, 41 are normally locked in place as illustrated, and can be removed by depressing the respective release buttons 40*b*, 41*b* and pulling the pin out of the respective engaging hole in the part 2.

Figure 2B:
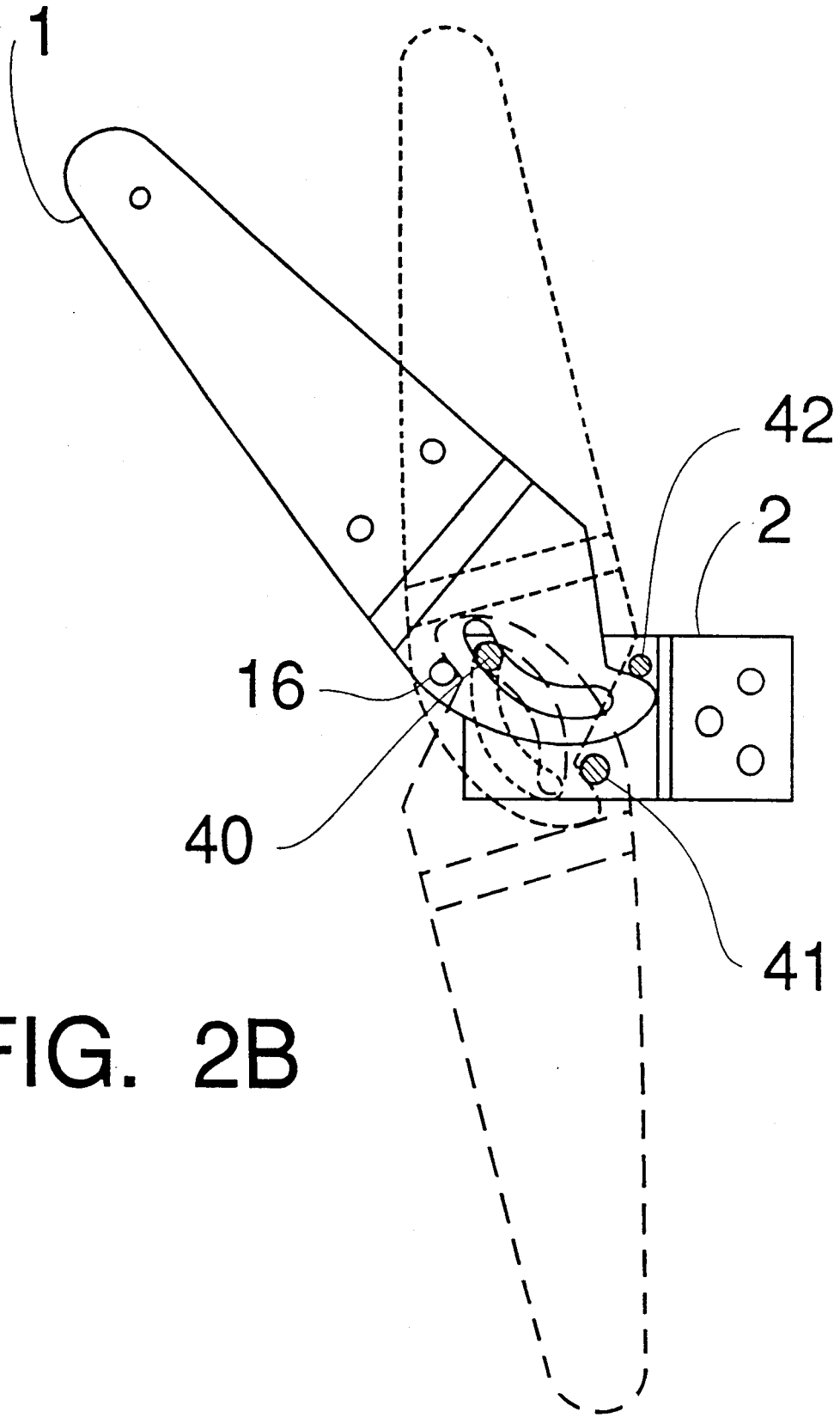

FIG. 2B a partially-cut-away elevation view of the fixed part 2, as seen from the right side of FIG. 2A as indicated by the section line IIB in FIG. 2A, with the two pins 40, 41 and the fixed pin 42 seen in cross-section. When the two parts 1 and 2 are together, the shank 40*a* of the first removable pin 40 passes through the curved slot 15. This is seen from FIG. 2B, which also indicates with solid lines the position of the rotating part at the inclined position, and with short and long dotted lines the positions of the rotating part 1 at the upright position and at the locked fully down position, respectively. The dimensions of the fixed part 2 as shown in FIG. 2A, to correspond to the above-given dimensions for the fixed part 1, are 3 and $\frac{3}{8}$ in. wide by 4 and $\frac{1}{2}$ in. high, with $\frac{1}{2}$ in. between the walls 23, 24. To avoid clutter, all the reference numerals of the parts 1 and 2 are not repeated in FIG. 2B, nor are all the details of part 1 shown for the upright and locked positions.

As can be seen also, in the upright position of the part 1, the surface 14 bears at least in part upward from below against the shank 41*a* of the pin 41, while the force of gravity (or any other means of providing a corresponding force for the bracket in any use) pulls the seat back down counterclockwise, so that the shank 40*a* of pin 40 bears at least in part from below on the inner surface 15*i* of the curved slot 15. From the combination of these forces of the pins 40 and 41 on the part 1, it can be seen that to rotate the part 1 backward from the upright position toward the intermediate position, it is first necessary to move the near end 11 of the part 1 backwards away from the pin 41, to allow the extreme tip 10 to move upward past the pin 41. While this can be accomplished by only lifting the part 1, or the seatback to which the part 1 may be attached, less lifting effort is required if the part 1 is first rotated forward or clockwise, and then lifted.

That is, if the part 1 is rotated forward a small amount as it is lifted upward, then a smaller lifting force is generally required than if it is simply lifted upward. This is seen from a straightforward analysis of the frictional and other forces involved. Namely, simply lifting the part 1 upward causes the point of contact of the pin 40 with the inner or outer surface 15*i*, 15*o* to move along the curved slot 15 toward the near end 11, while the shank 41*a* of the pin 41 slides along the surface 14. This involves two pairs of frictionally engaged surfaces, as compared to only one in the case of both rotating and lifting.

While in the upright position, the shank 42*a* of the fixed pin 42 can be arranged to bear against the surface 14*a* of the part 1, providing further stability to the seatback in the upright position, while leaving any desired amount of free play of the seatback in this position.

In the intermediate position of the part 1 or of the seatback, the surface 14 bears upward against the shank 41*a* of the fixed pin 42, and the inner surface 15*i* of the curved slot 15 bears down against the shank 40*a* of the pin 40. In the fully down position, the shank 40*a* of the pin 40 is all the way at the end of the curved slot 15 near the extreme tip 10 of the part 1, and the surface 13 can bear against the shank 41*a* of the pin 41, to define a positive end point to which the seatback can be moved.

The near end 11 of the rotating part 1 generally is held at an angle between the walls 23, 24 of the fixed part 2, because the seatback is generally tapered toward a rough apex at the top of the seatback, where the seatback supports 30 from both sides of the seat may come together, or toward which the two seatback supports 30 from both the left and right back corners of the seat 31 extend. This causes a binding of the rotating part 1 at one or more of its positions within the walls 23, 24 of the fixed part 2. This advantageously prevents any overly loose engagement of the seatback and seat, such as vibration of the two parts. Thus, a certainty and surety of each position of the seatback can be provided. For instance, the seatback can be securely fixed at the fully down position, without any need for locking it in this position, by adjusting the thickness of the plate of the part 1 which includes the near end 11, the inner spacing between the walls 23, 24 of the part 2, the angle of inclination of the rotating part 1 attached to the seatback 30, or a combination of these and any other relevant parameters. Generally, it is desired for this binding to be a maximum when the seatback is in the down position.

However, if it is desired to provide and actual locking of the seatback in the down position, the pin 41 can be removed, the part 1 rotated a small amount further so that the hole 16 in the part 1 lines up with the hole in part 2 for the pin 41, and the pin 41 then replaced. It is only necessary for the first one of the two brackets in the chair to have pin 41 to be removable, since the pin 41 in the first bracket suffices to define the positive stop point in the fully down position, by the bearing of the surface 13 against the shank 41*a*, and to provide the locking. In this case, an indentation is cut out of the part 1 of the second bracket along the surface 13 where the pin 41 of the second bracket is provided, to prevent the stopping action by the second bracket and to allow the part 1 of the second bracket to rotate all the way in to where the locking is achieved by the first bracket.

Figure 3:
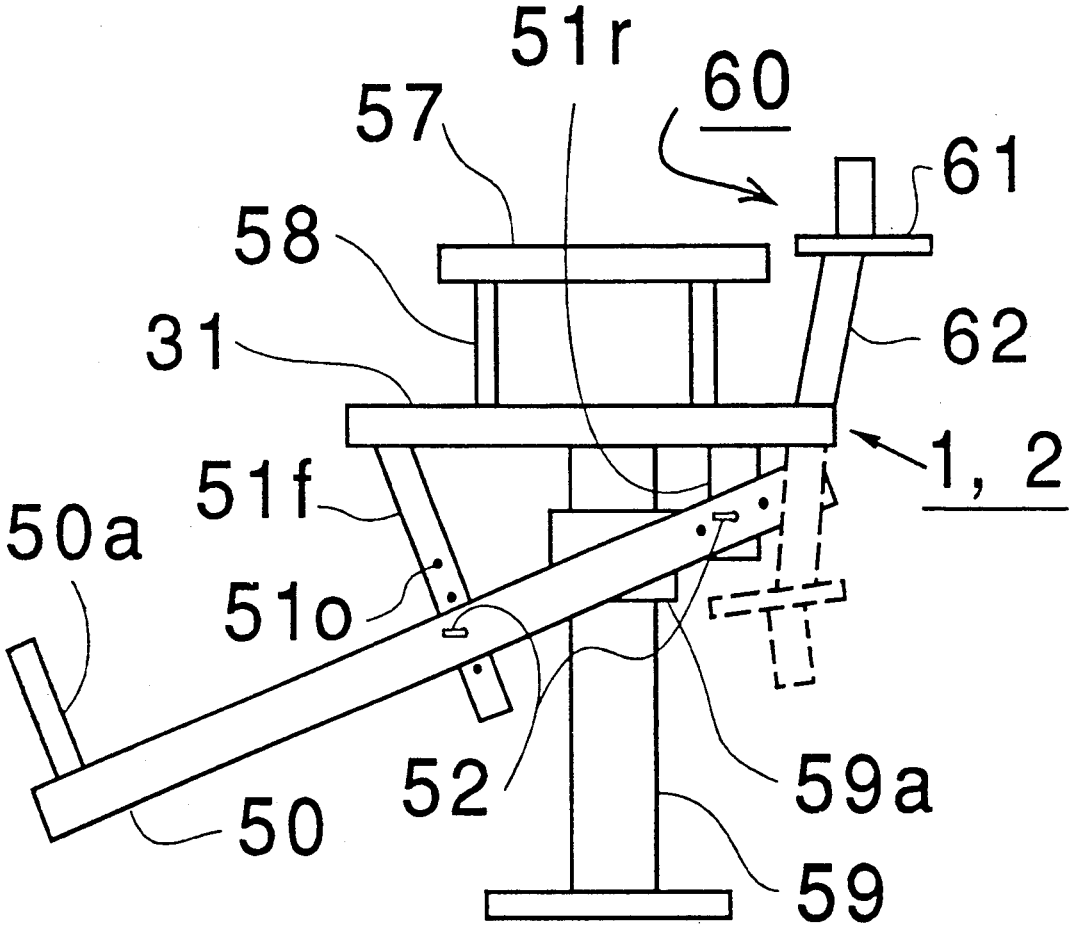
FIG. 3 shows a side view of the fishing chair with the rocket launcher in the upright position, and with dotted lines the path of motion of the rocket launcher when it is rotated around the end of the leg support to the lowered position.

FIG. 3 shows a side view of the fishing chair with the rocket launcher 60 in the upright position, and with dotted lines the path of motion and position of the rocket launcher 60 when it is rotated around the end of the leg support 50 to the lowered position. FIG. 3 also shows the seat 31 of the chair, supporting the armrest 57 via the armrest supports 58, the seat 31 supported by a cylinder 59 having a cylindrical bearing unit 59*a*, the leg rest 50*a* supported by the leg rest support 50, and the front and rear leg rest anchors 51*f*, 51*r* supporting the leg rest support 50. The front leg rest anchor 51*f* is rotatingly connected to a front part of the seat 31, and the rear leg rest anchor 51*r* is rigidly connected to rear part of the seat 31. The forward leg rest anchor 51*f* has a series of holes 51*o* into one of which one of the bars 52 is inserted to adjust the angle of extension of the leg rest support 50, and the rear end of the leg rest support 50 has a series of holes 50*o* for adjusting its point of engagement with the rear leg rest anchor 51*r* by means of the other bar 52.

The rocket launcher 60 comprises the supports 62 which are connected to the seat 31 of the chair by the brackets of the present invention, and the top member 61 which includes a plurality of short tubes extending upward, each tube receiving the end of a fishing rod.

A further description of the three positions of the swivel back of the chair is now given, to fully characterize the interactions of the parts of the left and right brackets to achieve the distinct advantages of the fighting chair of the present invention.

In the first, i.e., upright, position of the rotating part 1, wherein the end at the top of FIG. 1A is inserted into the opening in the fixed part 2 of FIG. 2A, the end of the slot 15 away from the tip end 10 rests on the pin 40, to help define a stop to limit the rotation of the back of the chair. At the same time, the surface 14*a* of the rotating part 1 rests on the fixed pin 42, which wedges the back bracket 1 to prevent it from rocking back and forth while the boat is underway. Also at the same time, the surface 14 rests against the shank 41*a* of the pin 41, which ensures that the back of the seat will not fold back without an upward and forward motion being applied.

As further above, in the second, i.e., reclining, position the fisherman is allowed more room to lean back while holding the fishing rod, for greater pull on the fish. This position also allows the crew person tending to the fisherman to hold onto the inclined chair back to rotate the chair to face towards the fish, while standing behind the chair.

In this reclining position, the rotating part 1 of the bracket as shown in FIGS. 1A and 1B is still inserted into the opening of the fixed part 2 of FIG. 2A, with the end of the slot 15 away from the tip end 10 still near the pin 40, again creating a stop for the rotation of the back of the chair. At the same time, the surface 14 of the rotating part 1 catches underneath the pin 42, which stops the back from rotating further backward and establishes the inclination angle of the seat back at the reclining position.

In the third, i.e., fully down, position, the fisherman is given the opportunity for a full back and forth motion when fighting the fish. In this position, the end of the slot near the tip end 10 hangs down from the pin 40, supporting the seat back above the deck.

In a fourth, i.e., locking, position very near to the third position, involving only a small further rotation of the seatback, the hole 16 in the rotating part 1 lines up with the position of the pin 41. To lock the seat back in this position, the pin 41 is removed, the seat back is rotated to the locked position, and the pin 41 is replaced, this time engaging the part 1 by extending through the hole 16. This locks the back under the chair so that in rough water the seat back will not move around from its position under the seat.

Each seat includes two brackets, a left-side bracket for the left side of the seat and a right-side bracket for the right. The two brackets are identical insofar as the features for defining the upright and reclined positions, but a difference arises as to the third, i.e., fully down, position and the fourth, i.e., locked, position. This difference is seen on comparison of FIGS. 1A and 4.

In the third, i.e., fully-down position, the surface 13 of the right-side bracket adjacent the end of the slot 15 away from the tip end 10 bears against the removable pin 41 of the right-side bracket. The seat back is firmly held in this position by the above-mentioned binding effect, without any further care being given to it. However, if it is desired to more firmly stow the seat back under the seat, the pin 41 of the right-side bracket can be removed to allow the seat back to rotate a small amount further, to the fourth position.

Figure 4:
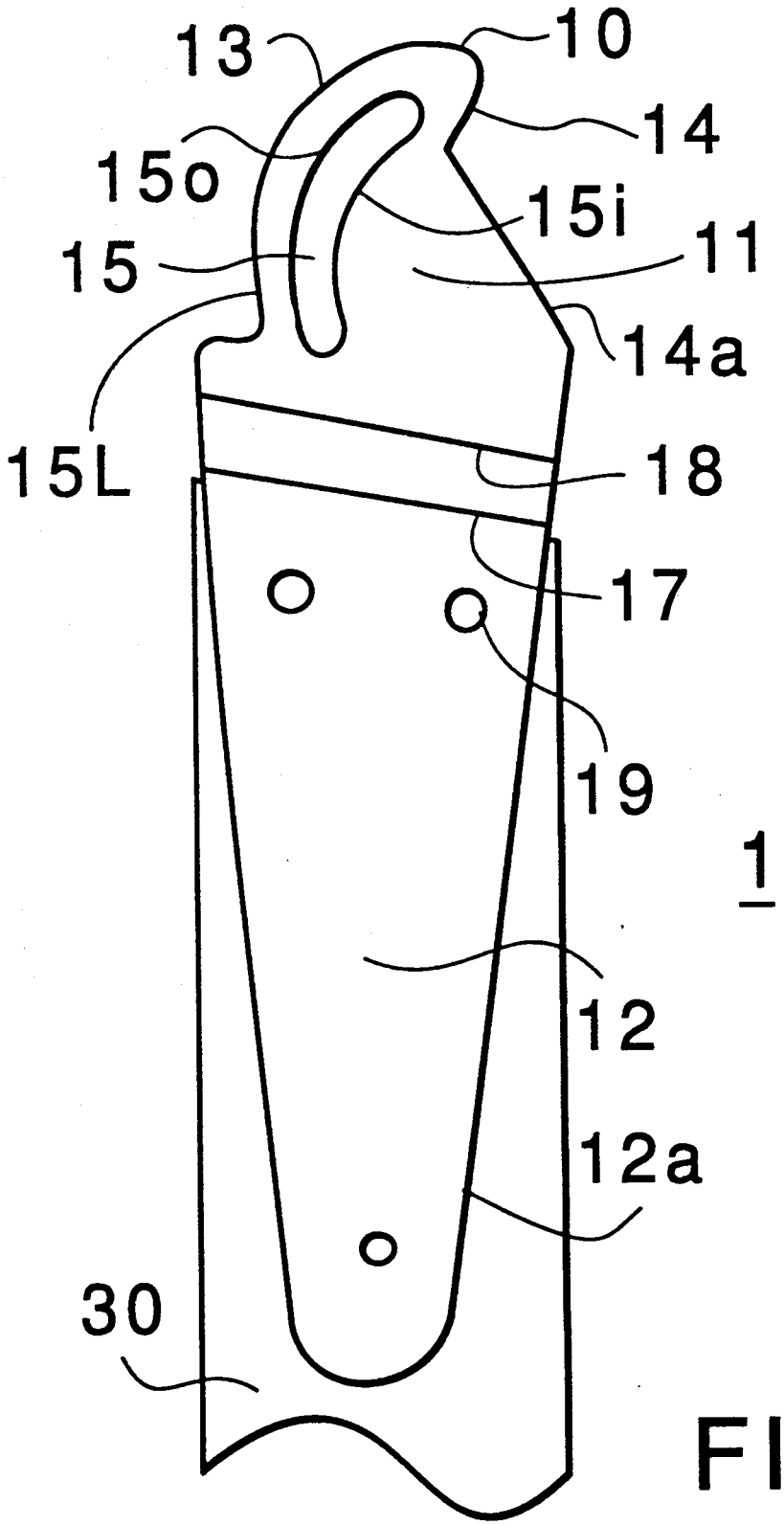
FIG. 4 shows a modification of the rotating part 1 for use in a chair, wherein the two brackets are slightly different, specifically as to the fully-down and locking positions.

In the fourth, i.e., locked position, the indented surface 15L of the rotating part 1 of the left-side bracket, as shown in FIG. 4, rests against the pin 41, which in the left-side bracket can be a fixed pin such as a welded pin. This provides a definite and positive stop for the rotation of the seat back, so that it comes to rest at the same position every time it is folded under the seat. At this well-defined position, the hole 16 in the right-side bracket is prearranged to line up with the pin 41, so that it is not necessary to search for the hole when replacing the pin 41 in the right-side bracket.

These similarities and differences of the left- and right-side brackets can be exactly the same when used in the rocket launcher and the captain', i.e., helm, chair described above.

The same brackets of the present invention can be used in the captain' chair on the flybridge (helm chair at the helm), to allow the captain to fold his chair back backward and down, to be entirely out of his way and out of his field of view of the fisherman. When the rocket launcher is used, it of course requires removal of the seatback from the chair. When a strike occurs, the rocket launcher is removed with the free rods, and the seatback can be replaced in position for the fisherman, as desired.

While the invention has been described in the more limited aspects of a preferred embodiment thereof, other embodiments of the invention have been suggested and still others will occur to those skilled in the art upon a reading and understanding of the foregoing specification. As but one example, a simplified version of the bracket described above could be used in connection with the rocket launcher or the captain' chair. It is intended that all such embodiments be included within the scope of the invention as limited only by the appended claims.

I claim:

1. A bracket comprising a first part including two parallel plates fixedly spaced from each other and joined at their forward ends, and at least two cross-parts extending perpendicularly to and between said two parallel plates, each said cross-part having a respective end-part which is engaged at a respective position on each respective one of said plates, a first of said at least two cross-parts being located below and closer to said forward ends than a second of said cross-parts, and a second part with a near end which extends between said two plates of said first part, said near end having an extreme tip, a slot through which said second one of said cross-parts passes, and a bearing edge surface in the vicinity of said extreme tip, said slot having an inner edge on the side of said slot closest to said bearing edge surface and an outer edge on the other side of said slot, said slot extending at least in part diagonally to a lengthwise direction of said second part, said second part having a far end opposite said near end, said slot having a near end on the side of said near end of said second part and a far end on the side of said far end of said second part, said at least in part diagonal extension of said slot including a portion of said slot, including said near end thereof, pointing roughly towards said bearing surface at said near end of said second part.

wherein when said second part is in a predetermined upright position relative to said first part, said bearing edge surface engages in part from below said first cross-part, and said second cross-part engages at least in part said inner edge of said slot at said far end of said slot; and wherein said second part can be rotated in a rearward direction from said upright position toward a fully-down position after only lifting said second part vertically while said second cross-part moves in said slot towards said near end of said slot, to allow said bearing edge surface and said extreme tip of said second part to clear said first cross-part and rise above it.

2. The bracket of claim 1, comprising said slot being a curving slot which curves from said near end thereof diagonally away from said extreme tip and toward said far end of said second part.

3. The bracket of claim 2, wherein said first cross-part is effectively rigidly connected with said two plates, and said second part has an indentation into which said first cross-part enters, when said second part is moved relative to said first part so that said cross-part moves to said near end of said curving slot and said first part is rotated from said upright position to said fully-down position.

4. The bracket of claim 3, comprising a third one of said cross-parts located above said first cross-part, said second part having a further bearing edge surface located adjacent to said bearing edge surface and on the other side thereof that said near end of said first, said further bearing edge surface extending diagonally with respect to said lengthwise direction of said second part and away from said near end of said slot, wherein when said second part is at a predetermined intermediate position relative to said first part, bearing edge surface contacts at least in part from below said third cross-part and said second cross-part contacts said inner edge of said slot, and wherein when said second part is at said upright position and rotated forwardly, in a direction toward said third cross-part, said further bearing edge surface contacts said third cross-part at least in part from above.

5. The bracket of claim 2, comprising a third one of said cross-parts located above said first cross-part, said second part having a further bearing edge surface located adjacent to said bearing edge surface and on the other side thereof that said near end of said first part, said further bearing edge surface extending diagonally with respect to said lengthwise direction of said second part and away from said near end of said slot, wherein when said second part is at a predetermined intermediate position relative to said first part, said bearing edge surface contacts at least in part from below said third cross-part and said second cross-part contacts said inner edge of said slot, and wherein when said second part is at said upright position and rotated forwardly, in a direction toward said third cross-part, said further bearing edge surface contacts said third cross-part at least in part from above.

6. A captian's chair incorporating the bracket of claim 5, wherein said first part is connected at a rear part of the seat of the captain's chair, said second part is connected at said far end to the back of the captain's chair, and the back of the captain's chair can be lowered backward to a position below and beneath the seat, wherein said back of the captain's chair is securely stowed at said position below the seat.

7. The bracket of claim 5, comprising said first and second cross-parts being removable pins, each said removable pin fitting into two respective holes in said two plates, and said third cross-part being fixed.

8. A chair for a fishing boat comprising at least one bracket as defined in claim 5, wherein said first part of said bracket is connected to the seat of the chair and said second part of said bracket is connected to one of a seatback of said chair or a rocket launcher.

9. The bracket of claim 1, comprising said first cross-part being removable, and said second part having a hole in the vicinity of said far end of said slot, wherein when said first cross-part is removed from said first part and said second part is moved relative to said first part so that said second cross-part moves to said near end of said slot, and said second part is rotated from said upright position to a fully-down position, said first cross-part can be replaced by being passed through said hole in said second part, whereby said second part is locked in said fully-down position.

10. The bracket of claim 1, comprising a third one of said cross-parts located above said first cross-part, wherein when said second part is at a predetermined intermediate position relative to said first part, said bearing edge surface contacts at least in part from below said third cross-part and said second cross-part contacts at least in part from below said inner edge of said slot.

11. A chair for a fishing boat comprising at least one bracket as defined in claim 10, wherein said first part of said bracket is connected to the seat of the chair and said second part of said bracket is connected to one of a seatback of said chair or a rocket launcher.

12. A fighting chair incorporating the bracket of claim 1, comprising a seat having a rear part connected to said first part of said bracket, with said forward end of said first part oriented in a forward direction of said seat, and a seatback connected to said second part via a seatback support connected to and extending from said far end of said second part, wherein said seatback must be raised vertically by lifting while said second cross-part moves in said slot toward said near end of said curving slot, for said allowing of said bearing edge surface and said extreme tip of said second part to pass by said first cross-part, before said second part can be rotated said upright position toward a fully-down position.

13. A fighting chair of claim 8, wherein said seatback is in a respective fully-down position when said second part of said bracket is in said fully-down position of said second part.

14. The fighting chair of claim 13, comprising a further bracket, said further bracket comprising a respective first part including two respective parallel plates fixedly spaced from each other and joined at a forward end of said respective first part, and at least two respective cross-parts extending perpendicularly to and between said two respective parallel plates, a first of said two respective cross-parts being located below and closer to said respective forward end than the second of said respective cross-parts, and a respective second part with a respective near end which extends between said two respective plates of said respective first part, said respective near end having a respective extreme tip, a respective curving slot through which a respective second one of said cross-parts passes, and a respective bearing edge surface in the vicinity of said respective extreme tip, said respective curving slot having a respective inner edge and a respective outer adge as its sides, and a respective near end in the vicinity of said respective extreme tip of said second part, said respective curving slot curving away from said respective near end thereof in said vicinity of said respective extreme tip toward a far end of said second part opposite said near end thereof, wherein:

when said respective second part is in a respective predetermined upright position relative to said respective first part, said respective bearing edge surface engages in part from below said respective first cross-part, and said respective second cross-part engages at least in part from below said respective inner edge of said respective curving slot at a position in said respective curving slot away from said respective extreme tip;

said respective second part can be rotated in a direction from said respective upright position toward a respective fully-down position after only lifting said respective second part vertically while said respective second cross-part moves in said respective curving slot toward said respective near end of said respective curving slot, to allow said bearing edge surface and said respective extreme tip of said respective first part to pass by said respective first cross-part when said second part is subsequently rotated toward said fully down position;

said respective first cross-part of said further bracket is effectively rigidly connected to said two respective plates;

said respective first part of said further bracket has an indentation into which said respective first cross-part enters, when said respective first part is moved relative to said respective second part so that said respective second cross-part moves to said respective first end of said respective curving slot, and said respective first part is rotated from said respective upright position to said respective fully-down position; and said respective upright and fully-down positions of said further bracket correspond to said upright and fully-down positions of said bracket of claim 1.

15. The fighting chair of claim 14, wherein said brackets are connected to said seat and seatback so that when said seatback is in its respective fully-down position, it is held firmly there as a result of a pressure and friction between respective surfaces of said first and second parts of said brackets.

16. The fighting chair of claim 15, wherein said pressure arises at least in part as a result of:

the spacing between said two plates of said first part of said first bracket and the height and width of said two plates;

the thickness and width of said near end of said second part between said parallel plates, and the position of said curving slot thereof; and the respective angles of attachment of said first and second parts of said first and second brackets to said seat and seatback.

17. The fighting chair of claim 12, comprising a rocket launcher connected to said second part instead of said seatback.

18. A fighting chair comprising a seat having a forward edge and a rear edge, support beam means suspended below said seat, support beam means having a forward end extending downwardly forward of said forward edge and a rear edge extending below said seat in the vicinity of said rear edge, a rocket launcher connected by two brackets to said seat in the vicinity of said forward edge, at least one of said brackets comprising 1) a first part including a first plate joined at a forward end of said first part, and at least two cross-parts extending perpendicularly to said first plate, a first of said two cross-parts being located below and closer to said forward end than the second of said cross-parts, and 2) a second part with a near end which extends adjacent said first plate of said first part, said near end having an extreme tip, a curving slot through which a second one of said cross-parts passes, and a bearing edge surface in the vicinity of said extreme tip, said curving slot having a inner edge and a outer edge as its sides and a near end in the vicinity of said extreme tip of said second part, said slot extending away from said bearing edge surface toward a far end of said second part opposite said near end thereof, wherein:

when said second part is in a predetermined upright position relative to said first part, said bearing edge surface engages in part from below said first cross-part, and said second cross-part engages at least in part from below said inner edge of said curving slot at a far end of said curving slot opposite said near end thereof;

said second part can be rotated in a clockwise direction from said upright position toward a fully-down position after only lifting said second part vertically while said second cross-part moves in said curving slot toward said near end of said curving slot, to allow said bearing edge surface and said respective extreme tip of said first part to pass by said cross-part; and said rocket launcher can be rotated from said upright position to said fully-down position under said seat without hitting said rear end of said support beam means.

19. A captain's chair incorporating the bracket of claim 1, wherein said first part is connected at a rear part of the seat of the captain's chair, said second part is connected at said far end to the back of the captain's chair, and the back of the captain's chair can be lowered backward to a position below and beneath the seat, wherein said back of the captain's chair is securely stowed at said position below the seat.

20. The bracket of claim 1, comprising said first and second cross-parts being removable pins, each said removable pin fitting into two respective holes in said two plates.

21. A bracket comprising a first part including a plate having a forward end and at least two cross-parts extending perpendicularly to said plate, each said cross-part engaging said plate at a respective position on said plate, a first of said two cross-parts being located below and closer to said forward end than a second of said cross-parts, and a second part with a near end which extends adjacent said plates of said first part, said near end having an extreme tip, a slot through which said second one of said cross-parts passes, and a bearing edge surface in the vicinity of said extreme tip, said slot having an inner edge on the side of said slot closest to said bearing edge surface and an outer edge on the outer side of said slot, said slot extending at least in part diagonally to a lengthwise direction of said second part, said second part having a far end opposite said near end, said slot having a near end on the side of said near end of said second part and a far end on the side of said far end of said second part, said at least in part diagonally extending slot including a portion of said slot with said near end thereof pointing roughly towards said bearing edge surface at said near end of said second part, wherein:

when said second part is in a predetermined upright position relative to said first part, said bearing edge surface engages in part from below said first cross-part, and said second cross-part engages at least in part from below said inner edge of said slot at said far end of said slot; and said second part can be rotated in a rearward direction from said upright position toward a fully-down position after only lifting said second part vertically while said second cross-part moves in said slot toward a first end of said slot closest to said extreme end of said second part, to allow said bearing edge surface and said extreme tip of said second part to clear said first cross-part and rise above it.

22. A bracket of claim 21, comprising a third one of said cross-parts located above said first cross-part, said second part having a further bearing edge surface located adjacent to said bearing edge surface and on the other side thereof than said near end of said second part, said further bearing edge surface extending away from said bearing edge surface diagonally with respect to said lenghtwise direction of said second part and away from said near end of said slot, wherein when said second part is at a predetermined intermediate position relative to said first part, said bearing edge surface contacts at least in part from below said third cross-part and said second cross-part contacts at least in part from below said inner edge of said slot, and wherein when said second part is at said upright position, said further bearing edge surface contacts said third cross-part at least in part from above.

23. A chair for a fishing boat comprising at least one bracket as defined in claim 22, wherein said first part of said bracket is connected to the seat of the chair and said second part of said bracket is connected to one of a seatback of said chair or a rocket launcher.

24. A chair for a fishing boat comprising at least one bracket as defined in claim 21, wherein said first part of said bracket is connected to the seat of the chair and said second part of said bracket is connected to one of a seatback of said chair or a rocket launcher.

25. A bracket comprising a first part including a plate having a forward end and at least two cross-parts extending perpendicularly to said plate, each said cross-part engaging said plate at a respective position on said plate, a first of said two cross-parts being located below and closer to said forward end than a second of said cross-parts, said first cross-part being removable, and a second part with a near end which extends adjacent said plate of said first part, said near end having an extreme tip, a slot through which said second one of said cross-parts passes, and a bearing edge surface in the vicinity of said extreme tip, said slot having an inner edge on the side of said slot closest to said bearing edge surface and an outer edge on the other side of said slot, said slot extending at least in part diagonally to a lengthwise direction of said second part, said second part having a far end opposite said near end, said slot having a near end on the side of said near end of said second part and a far end on the side of said far end of said second part, and said second part having a hole in the vicinity of said far end of said slot, wherein when said second part is in a predetermined upright position relative to said first part, said bearing edge surface engages in part from below said first cross-part, and said second cross-part engages at least in part from below said inner edge of said slot at said far end of said slot;

wherein said second part can be rotated in a rearward direction from said upright position toward a fully-down position after said second part is only lifted vertically while said second cross-part moves in said slot toward said near end of said slot, to allow said bearing edge surface and said extreme tip of said second part to clear said first cross-part and rise above it, and wherein when said first cross-part is removed from said first part and said second part is moved relative to said first part so that said second cross-part moves to said near end of said slot, and said second part is rotated from said upright position to a fully-down position, said first cross-part can be replaced by being passed through said hole in said second part, whereby said second part is locked in said fully-down position.

* * * * *